United States Patent [19]

Luksch

[11] 4,355,612

[45] Oct. 26, 1982

[54] COOLING SYSTEM WITH REMOVABLE VALVE MEMBER

[75] Inventor: Heinrich E. Luksch, Kenosha, Wis.

[73] Assignee: Outboard Marine Corporation, Waukegan, Ill.

[21] Appl. No.: 231,982

[22] Filed: Feb. 6, 1981

[51] Int. Cl.[3] ..... F01D 7/16

[52] U.S. Cl. ..... 123/41.08; 236/34.5

[58] Field of Search ..... 123/41.08, 41.09, 41.1, 123/41.15; 236/34.5, 101.C; 440/2, 84, 88, 900

[56] References Cited

U.S. PATENT DOCUMENTS

| | | | |
|---|---|---|---|
| 2,086,360 | 7/1937 | Hill | 123/41.08 X |
| 2,510,473 | 6/1950 | Jensen | 236/34.5 |
| 3,700,166 | 10/1972 | Foults | 236/34.5 |
| 3,918,418 | 11/1975 | Horn | 123/41.08 |

*Primary Examiner*—William A. Cuchlinski, Jr.
*Attorney, Agent, or Firm*—Michael, Best & Friedrich

[57] ABSTRACT

Disclosed herein is an engine cooling system comprising a first wall in an engine block defining a coolant jacket including an upstream coolant jacket portion, a downstream coolant jacket portion, and a passage portion extending therebetween and including therein a valve seat, a second wall in the engine block defining a void opening into the exterior surface of the block and communicating with the coolant jacket in general alignment with the passage portion, a third wall in the engine block defining a recess opening into the exterior surface of the block and communicating with the void, a valve member having a flange with opposed first and second surfaces, which first surface engages the seat, a spring having a first end engaging the second flange surface and having a second end, a plug located in the void and having a surface engaging the second spring end, and an outer surface, and, a retainer located in the recess and engaging the outer plug surface to releasably retain the retainer in the recess and to releasably retain the valve member against movement away from the seat.

24 Claims, 3 Drawing Figures

COOLING SYSTEM WITH REMOVABLE VALVE MEMBER

BACKGROUND OF THE INVENTION

The invention relates generally to cooling systems for internal combustion engines and for other related applications. More particularly, the invention relates to arrangements for facilitating replacement of valve members.

Attention is directed to the U.S. Hill Pat. No. 2,086,360 disclosing a fitting which carries a thermal sensitive valve element and which is screwed over a side opening in a coolant jacket, so as to facilitate valve element replacement.

SUMMARY OF THE INVENTION

The invention provides an engine cooling system comprising an engine block including an exterior surface, first wall means in the engine block defining a coolant jacket including an upstream coolant jacket portion, a downstream coolant jacket portion, and a passage portion extending between the upstream portion and the downstream portion and including therein a valve seat, second wall means in the engine block defining a void opening into the exterior surface of the block and communicating with the coolant jacket in general alignment with the passage portion, third wall means in the engine block defining a recess opening into the exterior surface of the block and communicating with the void, a valve member engaging the seat, a spring having a first end engaging the valve member and having a second end, a plug located in the void, and having a surface engaging the second spring end, and an outer surface, and a retainer located in the recess and engaging the outer plug surface to releasably retain the retainer in the recess and to releasably retain the valve member against movement away from the seat.

In one embodiment in accordance with the invention, the plug includes a peripheral surface, and the system further includes means providing a seal between the plug peripheral surface and the second wall means so as to prevent passage therebetween of coolant.

In one embodiment in accordance with the invention, the valve member is part of a pressure sensitive valve.

In one embodiment in accordance with the invention, the valve member is part of a temperature sensitive valve.

In one embodiment in accordance with the invention, the void is generally cylindrical and the resess extends generally perpendicularly to the axis of the cylindrical void.

In one embodiment in accordance with the invention, the valve member, and the plug, and the spring are insertable in, and removable from, the void, and the retainer is insertable in, and removable from, the recess.

In one embodiment in accordance with the invention, the outer surface of the plug comprises a projection, and the retainer includes a surface having a socket which receives the projection, and the retainer includes an aperture which, when the retainer is fully inserted in the resess, is accessible through the void, and which communicates with the socket to facilitate application to the plug of pressure directed inwardly of the void so as to release the projection from the socket.

In one embodiment in accordance with the invention, the plug and the spring are preassembled together.

In one embodiment in accordance with the invention, the plug, and the spring, and the valve member are preassembled together.

In one embodiment in accordance with the invention, the resess is generally of U shape and includes a bite portion which is aligned with the void and which is of greater dimensions than the void.

In one embodiment in accordance with the invention, the block further includes a passage communicating between the exterior of the block and the bite portion of the recess.

In one embodiment in accordance with the invention, the retainer extends, when fully inserted in the recess, exteriorly of the recess and includes therein an aperture located exteriorly of the recess.

Other features and advantages of the embodiments of the invention will become known by reference to the following general description, claims and appended drawings.

IN THE DRAWINGS

Figure 1:
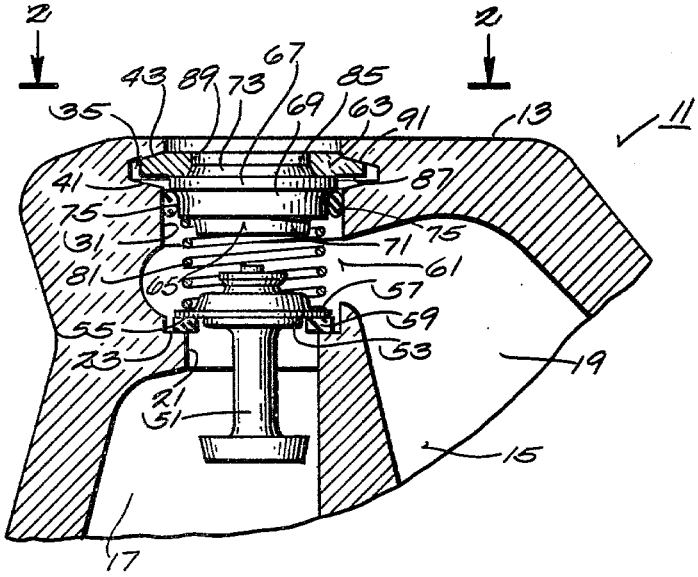
FIG. 1 is a fragmentary view, partially in section, of a coolant system embodying various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 2:
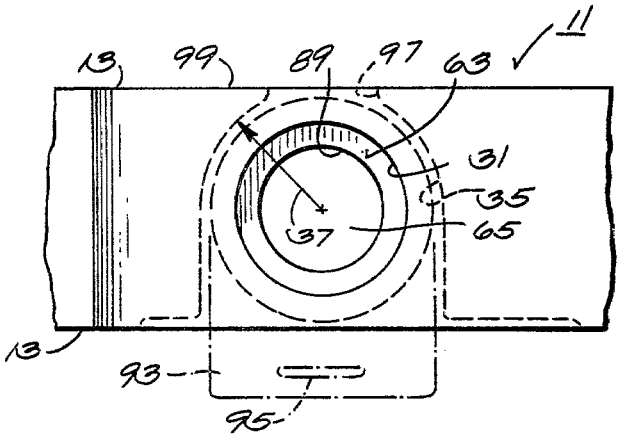
FIG. 2 is a fragmentary view, taken generally along line 2—2, of FIG. 1.

Shown fragmentarily in FIGS. 1 and 2 is an engine block 11 including an exterior surface 13, together with first wall means in the engine block 11 defining an interior engine coolant jacket 15 including an upstream portion 17, a downstream portion 19, and a passage portion 21 communicating between the upstream and downstream portions 17 and 19 and including therein an annular seat 23.

Also included in the engine block 11 is second wall means defining a generally cylindrical void or passage 31 extending generally in alignment with the passage portion 21 of the coolant jacket 15 from the exterior surface 13 of the block 11 to the downstream portion of the coolant jacket 15. The diameter of the cylindrical void 31 is generally at least as great as the diameter of the seat 23.

In addition, the engine block 11 further includes third wall means defining a side cavity or recess 35 which extends perpendicularly to the axis of the cylindrical void 31 and which also opens into the exterior surface 13 of the block 11 in spaced rotation to the opening of the void or passage 31 into the exterior surface 13 of the block 11. The side recess 35 is generally U-shaped with a bite portion which is co-axial with the axis of the cylindrical void 31 and which has a radius 37 greater than the radius of the cylindrical void 31.

Figure 3:
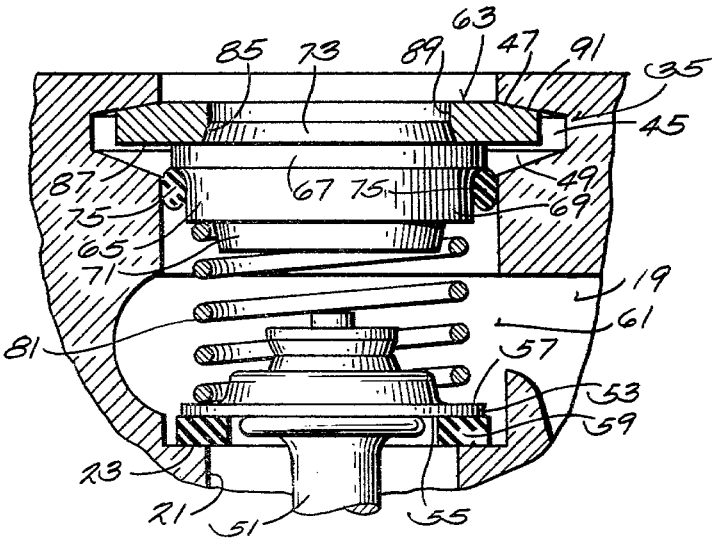
FIG. 3 is an enlarged view, partially in section, of a portion of the cooling system shown in FIG. 1.

The side recess 35 has axially spaced inner and outer surfaces 41 and 43 which, in the area of the bite portion, are preferably conically shaped. Outwardly of the bite portion and toward the access opening, (See FIG. 3) the side recess 35 has a cross section with a midportion 45 of rectangular shape and with axially outer and inner end portions 47 and 49 of trapezoidal shape so as to afford unrestrained access to the bite portion of the side recess 35.

Located in the passage portion 21 of the coolant jacket 15 is a valve member 51 which can be either a thermostatic valve member or a pressure relief valve member and which includes a flange 53 having opposed inner and outer surfaces 55 and 57, respectively, with the inner surface 55 having fixed thereon a washer 59 of nylon or other similar material which, when the valve member 51 is seated, engages the seat 23 to prevent coolant flow between the valve member 51 and the seat 23.

The valve member 51 is releasably retained in seated condition by a spring and plug assembly 61 which extends in the cylindrical void 31 and which is releasably retained therein in engagement with the valve member 51 by a non-deformable retainer or member 63 which is releasably retained in the recess 35 and cooperates with the spring and plug assembly 61.

More particularly, the plug and spring assembly 61 comprises a plug 65 which is generally cylindrical in shape, having a maximum diameter portion 67 which is slightly less than the diameter of the cylindrical void 31. Extending axially inwardly of the maximum diameter portion 67 is a first portion 69 of reduced diameter and a second portion 71 of still further reduced diameter. Extending axially outwardly from the maximum diameter portion 67 is a truncated conical portion or projection 73.

Sealing means are provided between the periphery of the first portion 69 of reduced diameter and the second wall means defining the cylindrical void 31. While various arrangements can be employed, in the illustrated construction, such means comprises an O-ring 75 which engages the inner surface of the cylindrical void 31 and the peripheral surface of the first portion 69 of reduced diameter adjacent to the maximum diameter portion 67.

The plug and spring assembly 61 further includes a helical spring 81 which, at one end, has an interference fit about the periphery of the second portion 71 of reduced diameter, and which, at its other end, bears against the upper or axially outer surface 57 of the valve member flange 53.

The axially outer truncated conical portion or projection 73 of the plug 65 is selectively seated in a mating recess or socket 85 in the axially inner or undersurface 87 of the retainer 63 which is preferably a ring having an outer radius greater than the radius of the cylindrical void 31 and approaching the radius of the bite portion of the side recess 35. The retainer 63 has a central aperture 89 communicating with the conical undersurface recess 85 and has an axially outer or upper conical surface 91 which mates with the conical axially outer surface 43 of the side recess 35.

In assembly, the valve member 51 is initially inserted through the cylindrical void 31 and located with the nylon washer 59 in engagement with the seat 23. The spring and plug assembly 61, together with the sealing O-ring 75 are then inserted in the cylindrical void 31 until the free end of the spring 81 engages the axially outer flange surface 57 of the valve member 51 to hold the washer 59 against the seat 23.

The plug 65 is then inwardly further depressed into the cylindrical void 31 to below the side recess 35 to permit sliding passage through the side recess 35 and across the cylindrical void 31 of the retainer or member 63 into position permitting axially outward movement of the plug 65 so as to seat the axially outer conical portion 73 thereof in the conical undersurface or recess 85 of the retainer 63. As a consequence, the retainer 63 is releasably held against withdrawal in the side recess 35 and the plug and spring assembly 61 is releasably retained against withdrawal in the cylindrical void 31 with the flange 53 of the valve member 51 seated against the valve seat 23.

In order to remove the valve member 51 for replacement or otherwise, the plug 65 is releasably depressed into the cylindrical void 31 so as to disengage the axially outer truncated conical portion 73 of the plug 65 from the conical undersurface recess 85 of the retainer 63 and to permit withdrawal of the retainer 63 through the side recess 35. The plug and spring assembly 61 and the valve member 51 can then be withdrawn through the cylindrical void 31.

If the valve member 51 constitutes a thermostatic valve, the valve member operates internally to open ports (not shown) within the valve member in response to increasing temperature and the valve member flange 53 remains in seated engagement with the valve seat 23 at all times during operation.

If the valve member 51 is a pressure relief valve, when the pressure in the upstream portion 17 exceeds a predetermined limit, the pressure lifts the valve member flange 53 off the seat 23 against the action of the spring 81 to afford coolant flow around the periphery of the valve member flange 53.

If desired, the retainer 63 may have a portion 93 which is shown in dotted outline in FIG. 2 and which extends outwardly of the side recess 35 when the plug 65 and retainer 63 are interengaged, which extending portion 93 can be grasped to facilitate removal and which can include therein an aperture 95 permitting insertion of a screwdriver, or other like instrument, to afford leverage in removing the retainer 63 from the side recess 35.

If desired, the bite portion of the side recess 35 can communicate through a small passage or opening 97 (shown in dotted outline in FIG. 2) with an adjacent part 99 of the exterior surface 13 of the engine block 11 to permit insertion therethrough of a screwdriver, or other like instrument, to facilitate engagement with the retainer 63 and the application of force through the passage 97 to effect removal of the retainer 63 through the side recess 35.

If desired the spring and plug assembly 61 can be formed as part of a larger valve assembly which includes the valve member 51, as well as the spring and plug assembly 61, and which can be provided by connecting the axially inner end of the spring 81 to the valve member 51.

The construction disclosed herein thus provides a quick and easy arrangement facilitating access to, and removal and replacement of, a valve member from an engine cooling system on site and without the use of special tools or skills.

Various of the features of the invention are set forth in the following claims:

I claim:

1. An engine cooling system comprising an engine block including an exterior surface, first wall means in said engine block defining a coolant jacket including an upstream coolant jacket portion, a downstream coolant jacket portion, and a passage portion extending between said upstream portion and said downstream portion and including therein a valve seat, second wall means in said engine block defining a void opening into said exterior surface of said block and communicating with said coolant jacket in general alignment with said passage portion, third wall means in said engine block defining a recess opening into said exterior surface of said block and communicating with said void, a valve member engaging said seat, a spring having a first end engaging said valve member and having a second end, a plug located in said void, and having a surface engaging said second spring end, and an outer surface, and a non-deformable retainer located in said recess and engaging said outer plug surface to releasably retain said retainer in said recess and to releasably retain said valve member against movement away from said seat.

2. An engine cooling system in accordance with claim 1 wherein said plug includes a peripheral surface, and further including means providing a seal between said plug peripheral surface and said second wall means so as to prevent passage therebetween of coolant.

3. An engine cooling system in accordance with claim 1 wherein said valve member is part of a pressure sensitive valve.

4. An engine cooling system in accordance with claim 1 wherein said valve member is part of a temperature sensitive valve.

5. An engine cooling system in accordance with claim 1 wherein said void is generally cylindrical and said recess extends generally perpendicularly to the axis of said cylindrical void.

6. An engine cooling system in accordance with claim 1 wherein said valve member, and said plug, and said spring are insertable in, and removable from, said void, and wherein said retainer is insertable in, and removable from, said recess.

7. An engine cooling system in accordance with claim 1 wherein said outer surface of said plug comprises a projection, and wherein said retainer includes a surface having a socket which receives said projection, and wherein said retainer includes an aperture which, when said retainer is fully inserted in said recess, is accessible through said void, and which communicates with said socket to facilitate application to said plug of pressure directed inwardly of said void so as to release said projection from said socket.

8. An engine cooling system in accordance with claim 1 wherein said plug and said spring are preassembled together.

9. An engine cooling system in accordance with claim 1 wherein said plug, and said spring, and said valve member are preassembled together.

10. An engine cooling system in accordance with claim 1 wherein said retainer extends, when fully inserted in said resess, exteriorly of said recess and includes therein an aperture located exteriorly of said recess.

11. An engine cooling system comprising an engine block including an exterior surface, first wall means in said engine block defining a coolant jacket including an upstream coolant jacket portion, a downstream coolant jacket portion, and a passage portion extending between said upstream portion and said downstream portion and including therein a valve seat, second wall means in said engine block defining a void opening into said exterior surface of said block and communicating with said coolant jacket in general alignment with said passage portion, third wall means in said engine block defining a recess opening into said exterior surface of said block and communicating with said void, said recess being generally of U shape and including a bite portion which is aligned with said void and which is of greater dimensions than said void, a valve member engaging said seat, a spring having a first end engaging said valve member and having a second end, a plug located in said void, and having a surface engaging said second spring end, and an outer surface, and a retainer located in said recess and engaging said outer plug surface to releasably retain said retainer in said recess and to releasably retain said valve against movement away from said seat.

12. An engine cooling system in accordance with claim 11 wherein said block further includes a passage communicating between said exterior of said block and said bite portion of said resess.

13. An engine cooling system comprising an engine block including an exterior surface, first wall means in said engine block defining a coolant jacket including an upstream coolant jacket portion, a downstream coolant jacket portion, and a passage portion extending between said upstream portion and said downstream portion and including therein a valve seat, second wall means in said engine block defining a void opening into said exterior surface of said block and communicating with said coolant jacket in general alignment with said passage portion, third wall means in said engine block defining a recess opening into said exterior surface of said block in spaced relation to the opening of said void into said exterior surface of said block and communicating with said void, a valve member engaging said seat, a spring having a first end engaging said valve member and having a second end, a plug located in said void, and having a surface engaging said second spring end, and an outer surface, and a retainer located in said recess and engaging said outer plug surface to releasably retain said retainer in said recess and to releasably retain said valve member against movement away from said seat.

14. An engine cooling system in accordance with claim 13 wherein said plug includes a peripheral surface, and further including means providing a seal between said plug peripheral surface and said second wall means so as to prevent passage therebetween of coolant.

15. An engine cooling system in accordance with claim 13 wherein said valve member is part of a pressure sensitive valve.

16. An engine cooling system in accordance with claim 13 wherein said valve member is part of a temperature sensitive valve.

17. An engine cooling system in accordance with claim 13 wherein said void is generally cylindrical and said recess extends generally perpendicularly to the axis of said cylindrical void.

18. An engine cooling system in accordance with claim 13 wherein said valve member, and said plug, and said spring are insertable in, and removable from, said void, and wherein said retainer is insertable in, and removable from, said recess.

19. An engine cooling system in accordance with claim 13 wherein said outer surface of said plug comprises a projection, and wherein said retainer includes a surface having a socket which receives said projection, and wherein said retainer includes an aperture which, when said retainer is fully inserted in said recess, is accessible through said void, and which communicates with said socket to facilitate application to said plug of pressure directed inwardly of said void so as to release said projection from said socket.

20. An engine cooling system in accordance with claim 13 wherein said plug and said spring are preassembled together.

21. An engine cooling system in accordance with claim 13 wherein said plug, and said spring, and said valve member are preassembled together.

22. An engine cooling system in accordance with claim 13 wherein said resess is generally of U shape and includes a bite portion which is aligned with said void and which is of greater dimensions than said void.

23. An engine cooling system in accordance with claim 22 wherein said block further includes a passage communicating between said exterior of said block and said bite portion of said resess.

24. An engine cooling system in accordance with claim 13 wherein said retainer extends, when fully inserted in said resess, exteriorly of said recess and includes therein an aperture located exteriorly of said recess.

* * * * *